US010982837B2

(12) United States Patent
Jiang

(10) Patent No.: US 10,982,837 B2
(45) Date of Patent: Apr. 20, 2021

(54) GRADIENT FROSTING SYSTEM

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 16/790,209

(22) Filed: Feb. 13, 2020

(65) Prior Publication Data

US 2020/0182435 A1 Jun. 11, 2020

Related U.S. Application Data

(63) Continuation of application No. PCT/CN2018/099034, filed on Aug. 6, 2018.

(30) Foreign Application Priority Data

Aug. 15, 2017 (CN) ..... 201710698425.8

(51) Int. Cl.
*F21V 14/08* (2006.01)
*F21V 3/00* (2015.01)
*F21W 131/406* (2006.01)

(52) U.S. Cl.
CPC ..... *F21V 14/08* (2013.01); *F21V 3/00* (2013.01); *F21W 2131/406* (2013.01)

(58) Field of Classification Search
CPC ... F21W 2131/406; F21V 14/08; F21V 14/06; F21V 17/02; F21S 41/635
(Continued)

(56) References Cited

U.S. PATENT DOCUMENTS 4,745,531 A * 5/1988 Leclercq ..... F21V 11/18 362/281
2008/0247025 A1 10/2008 Junk
(Continued)

FOREIGN PATENT DOCUMENTS

CN 86104591 A 4/1987
CN 201344458 Y 11/2009
(Continued)

OTHER PUBLICATIONS

Search report from International Application No. PCT/CN2018/099034, dated Oct. 10, 2018.
(Continued)

*Primary Examiner* — William J Carter
(74) *Attorney, Agent, or Firm* — Lerner, David, Littenberg, Krumholz & Mentlik, LLP

(57) ABSTRACT

The prevent invention discloses a gradient frosting system comprising a light processing mechanism arranged in a direction of a primary optical axis of a light beam, a frosting mechanism perpendicular to the primary optical axis of the light beam, and a power mechanism for outputting power to drive the frosting mechanism to move, wherein the frosting mechanism comprises two frosting components, including a left frosting component and a right frosting component, moving towards or away from each other, and the left and right frosting components are arranged on the power mechanism and driven by the power mechanism to conduct open-close motion in a plane perpendicular to the primary optical axis. According to the present invention, the frosting effect generated is multi-level, gradually varied, and uniform in frosting level, which can better heighten the stage atmosphere and adapt to the presentation of various stage effects.

18 Claims, 4 Drawing Sheets

(58) Field of Classification Search
USPC ..... 362/18, 284
See application file for complete search history.

(56) References Cited

U.S. PATENT DOCUMENTS

| | | | | |
|---|---|---|---|---|
| 2009/0231854 | A1 | 9/2009 | Junk | |
| 2011/0080735 | A1* | 4/2011 | Quadri | F21V 11/06 362/277 |
| 2011/0103074 | A1* | 5/2011 | Jurik | F21V 11/18 362/355 |

FOREIGN PATENT DOCUMENTS

| | | | |
|---|---|---|---|
| CN | 201827831 | U | 5/2011 |
| CN | 102297390 | A | 12/2011 |
| CN | 102753884 | A | 10/2012 |
| CN | 203823664 | U | 9/2014 |
| CN | 104266109 | A | 1/2015 |
| CN | 107477511 | A | 12/2017 |
| CN | 207268425 | U | 4/2018 |
| WO | 0221041 | A1 | 3/2002 |
| WO | 2011032058 | A2 | 3/2011 |

OTHER PUBLICATIONS

Chinese Search Report for Application No. 201710698425.8 dated Apr. 15, 2020, 1 page.
Chinese Search Report for Application No. 201710698425.8 dated Jun. 14, 2019, 1 page.
Extended European Search Report with Written Opinion for 18846863.1 dated Jul. 17, 2020, 9 pages.

* cited by examiner

GRADIENT FROSTING SYSTEM

CROSS REFERENCE TO RELATED APPLICATIONS

The present application is a continuation of International Application No. PCT/CN2018/099034, filed on Aug. 6, 2018, which claims priority from Chinese Patent Application No. 201710698425.8 filed on Aug. 15, 2017, all of which are hereby incorporated herein by reference.

TECHNICAL FIELD

The present invention relates to the technical field of stage lights, and in particular to a gradient frosting system.

BACKGROUND

In order to enrich the stage art effect and heighten atmosphere, a variety of effect components, such as color wheel components, pattern components, prisms and frosting plate components, are often additionally arranged in an optical system of a stage light to achieve a variety of lighting effects. A frosting plate is driven to a position of shielding light beams so as to obtain more uniform and soft light beams, thus rendering the stage background and heightening the scene atmosphere. The frosting component used in the existing stage light technology is a single frosting plate which enters a light path from one side until it completely shields light beams. Such single frosting plate can achieve only one frosting effect, the light beam is not uniform even if the light beam is partially shielded to be mildly frosted, and even some frosting components will produce light reflection, light shielding and other phenomenon, which affects the use effect. However, different frosting effects are usually required during stage performances, and thus requiring multiple stage lights with different frosting effects, which will bring great inconvenience to stage art design.

SUMMARY

In order to overcome the existing technical defects, the present invention provides a gradient frosting system that can achieve different frosting effects with same stage light.

A gradient frosting system according to the present invention comprises a light processing mechanism arranged in a direction of a primary optical axis of a light beam, a frosting mechanism arranged perpendicular to the primary optical axis of the light beam, and a power mechanism for outputting power to drive the frosting mechanism to move, wherein the frosting mechanism comprises two frosting components, including a left frosting component and a right frosting component, moving towards or away from each other, and the left and right frosting components are arranged on the power mechanism and driven by the power mechanism to conduct open-close motion in a plane perpendicular to the primary optical axis.

The frosting component is mainly used to shield the light beam, such that the light beam emitted by a light source has a fog-covered hazy effect. The power mechanism is mainly used to drive and transfer the left and right frosting components to conduct open-close motion in the plane perpendicular to the primary optical axis, resulting in a gradient frosting effect, which is from no frosting effect to having frosting effect. When the left and right frosting components are opened, light beams will pass through an opening between the two frosting components without being shielded, there is no frosting effect; and when the left and right frosting components are closed, some of the light beams passing through the frosting components will be shielded by the frosting components, and some of the light beams are not shielded by the frosting components, thereby producing a frosting effect.

Further, groups of frosting mechanisms are provided and arranged up and down in the plane perpendicular to the primary optical axis. Correspondingly, groups of power mechanisms are provided and arranged corresponding to the frosting mechanisms one by one. Each group of frosting mechanisms is provided with two frosting components moving towards or away from each other.

According to the prevent invention, groups of frosting mechanisms and power mechanisms are arranged, each group of frosting mechanisms comprises a left frosting component and a right frosting component, and the left and right frosting components are respectively arranged at the left and right sides of the power mechanism, so that when the power mechanism is actuated, the left and right frosting components of groups of frosting mechanisms conduct open-close motion, thus achieving more intensive and obvious frosting effect compared to a single frosting mechanism.

Further, each group of power mechanism comprises a slider component and a driving component, the slider component is respectively connected to the frosting component and the driving component, and the slider component is driven by the driving component to move towards or away from each other to enable the left and right frosting components to conduct open-close motion in the plane perpendicular to the primary optical axis.

The slider component is connected to the frosting components and is mainly used to drive the frosting component to move left and right, such that the left and right frosting components can conduct open-close motion in the plane perpendicular to the primary optical axis. The driving component is connected to the slider component, and provides power to drive the slider component to move, thus driving the frosting components to move, achieving gradient frosting process in automation and order.

Further, the power mechanism comprises a slider component and a driving component, the slider component is respectively connected to the frosting components and the driving component, the left and right frosting components are arranged up and down at an interval in height, and the slider component is driven by the driving component to move towards or away from each other to enable the left and right frosting components to conduct open-close-overlap motion in the plane perpendicular to the primary optical axis.

The left and right frosting components are arranged up and down at an interval in height, so that when the left and right frosting components moves towards each other and the two frosting components have their upper and lower edges to be in a same horizontal plane parallel to the primary optical axis, the left and right frosting components are in a closed state, and when the two frosting components further move forward towards each other, the two frosting components will have their upper and lower sides to be staggered, thus forming an overlapping frosting state to generate a gradient frosting effect which is from no frosting effect to having frosting effect, and from shallow to deep.

Further, the slider component comprises two sliders for driving the frosting components to move and a sliding shaft or a sliding rail for guiding the sliders, the two sliders are respectively connected to the left and right frosting components, and the sliders are arranged on the sliding shaft or the sliding rail.

Further, two ends of the sliding shaft are respectively provided with a sliding shaft fixing base for fixing the sliding shaft, the sliding shaft is provided, in the middle, with a limiting member for limiting the travel distance of the slider, and the limiting member passes through the sliding shaft.

Further, the driving component comprises a transfer mechanism for driving the slider to move and a driving motor for driving the transfer mechanism to move, the driving motor is mounted below a support frame and is connected to the transfer mechanism, and the transfer mechanism is mounted above the support frame and connected to the slider component.

Further, the transfer mechanism comprises a driving wheel, a driven wheel and a driving belt, the driving wheel is connected to the driving motor, the driven wheel and the driving wheel are respectively mounted below the slider component, the driving belt is mounted on the driving wheel and the driven wheel and follows the motion of the driving wheel, the two sliders are respectively and correspondingly arranged at two sides of the driving belt, and the two sides of the driving belt respectively provide driving forces in opposite directions for the two sliders.

Further, the driving belt is provided with two symmetrically arranged sliding guides, and the sliding guide is connected to the slider component and follows the motion of the driving belt.

Further, the light processing mechanism comprises a light source component, a focusing component, a magnifying lens component and a fixed lens component, which are sequentially arranged in the direction of the primary optical axis of the light beam, the frosting mechanism is arranged between the focusing component and the fixed lens component, and the magnifying lens component is arranged between the frosting mechanism and the power mechanism and forms a frosting module with the frosting mechanism.

The magnifying lens component is mainly used to concentrate and restrain light, so that the light beam passing therethrough is brighter and has a longer range.

Further, the frosting component comprises a frosting plate and a mounting plate for carrying and mounting the frosting plate, the mounting plate is connected to the slider, and the slider is connected to the sliding guide.

The frosting plate is generally made of glass. If the frosting plate is fixed to the slider component alone, it is generally difficult to be fixed. By means of fixing the mounting plate on the frosting plate and further fixing the slider component on the mounting plate, the problem of connection between the frosting plate and the slider component can be well solved, so that the slider can drive the frosting plate to move by means of driving the mounting plate to move, thus achieving the frosting effect. In addition, since the mounting plate is detachably connected to the frosting plate, the frosting plate can be conveniently replaced. Therefore, the cost of subsequent maintenance can be reduced.

Further, the frosting plate is coated, in a tangent plane which is parallel to the primary optical axis and into which the light beam enters tangentially, with a film for preventing light from being refracted from the tangent plane to interfere with light rays.

Compared with the prior art, the present invention can obtain some beneficial effects. According to the present invention, the frosting effect generated is multi-level, gradually varied, and uniform in frosting level, which can better heighten the stage atmosphere, and can adapt to the presentation of various stage effects.

Preferably, the frosting plate 211 is coated with a film 213 in a tangent plane thereof which is parallel to the primary optical axis and into which the light beam enters tangentially. The film 213 can prevent light from being refracted from the tangent plane to interfere with light rays.

DETAILED DESCRIPTION OF EMBODIMENTS

In order to make the object, technical solutions and advantages of the present invention clearer, the embodiments of the present invention are described in further detail below with reference to the accompanying drawings.

Embodiment 1

Figure 1:
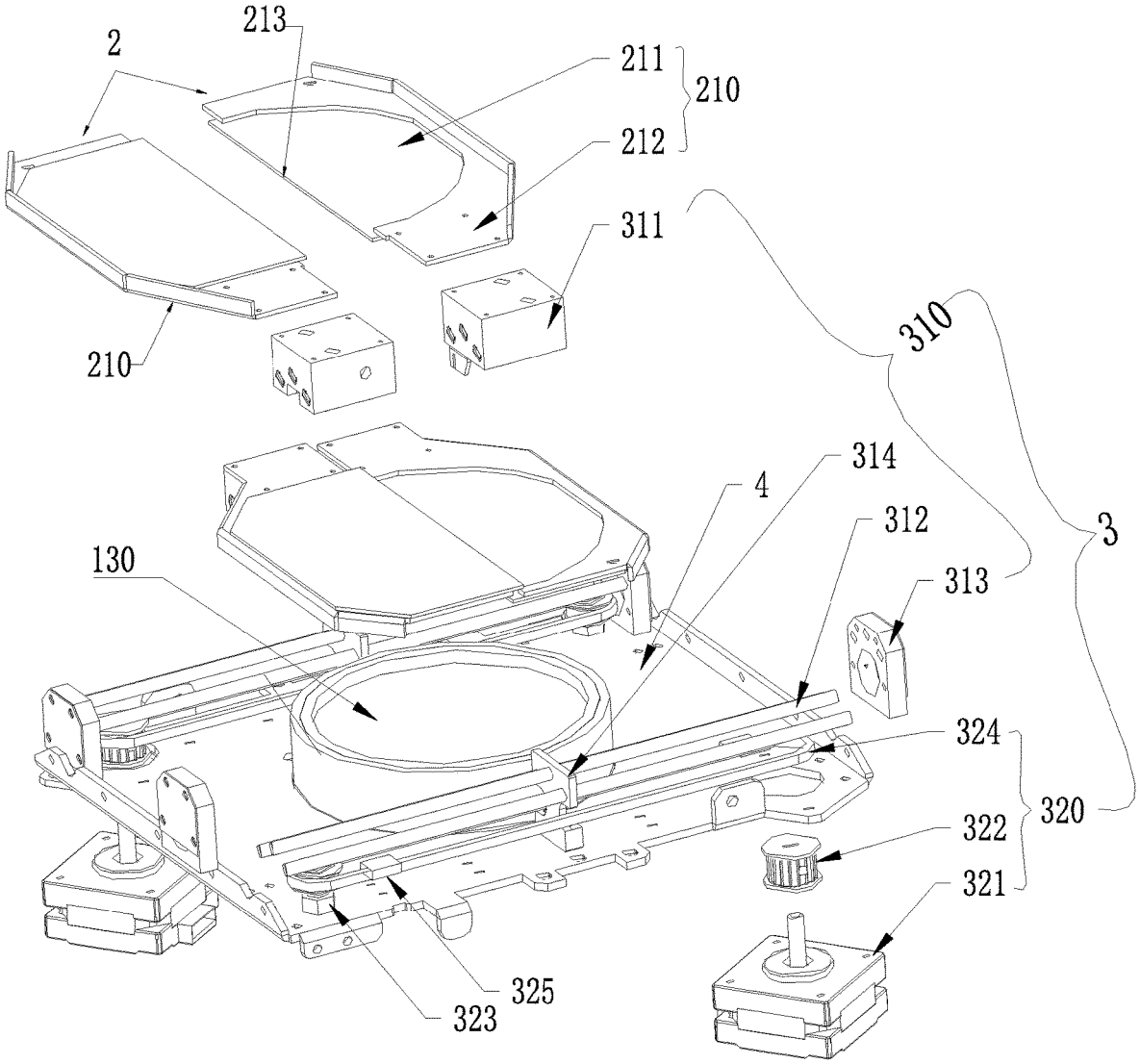
FIG. 1 is a structural schematic view of the present invention in disassembly.
Figure 2:
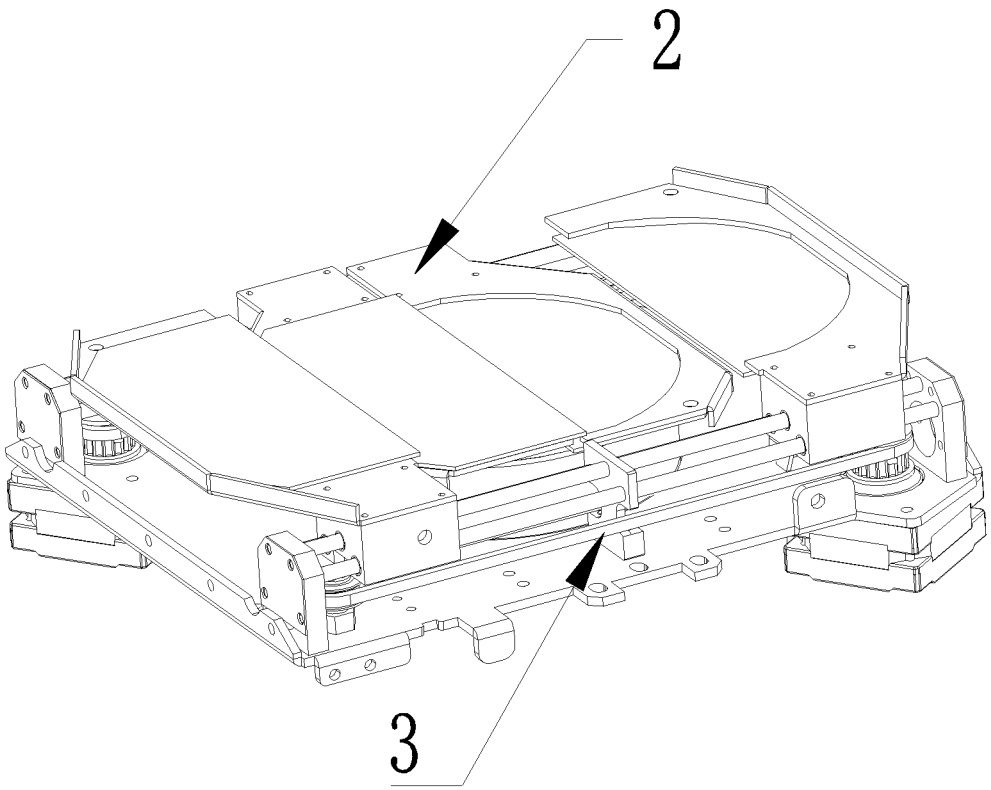
FIG. 2 is a structural schematic view of the present invention in assembly.
Figure 3:
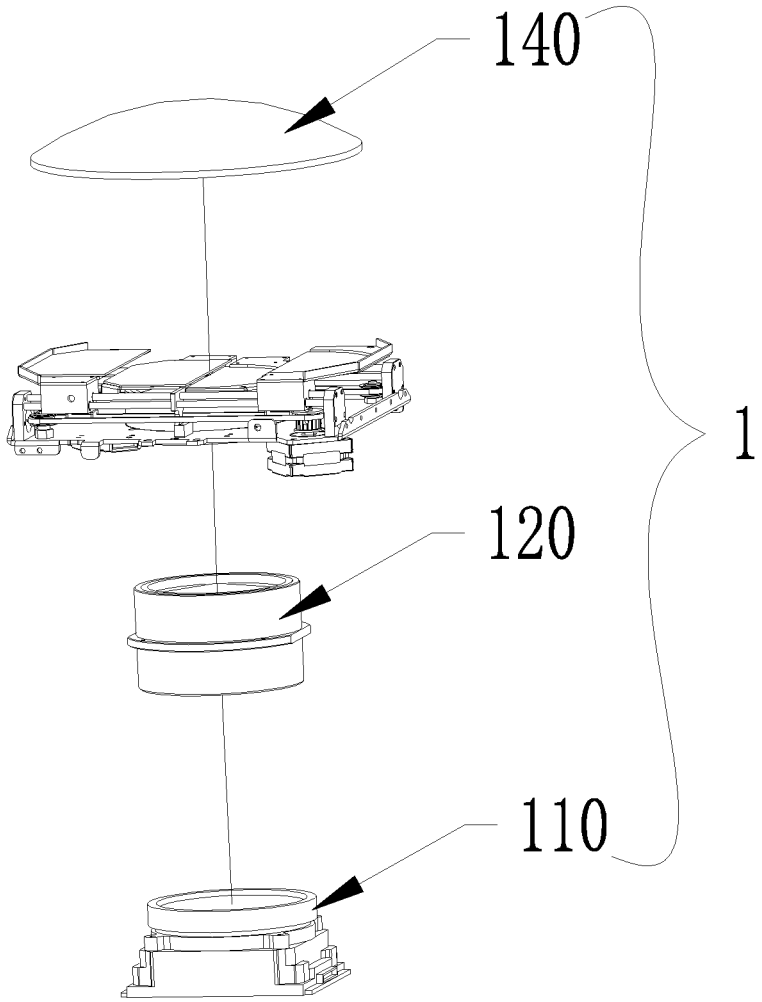
FIG. 3 is an installation structural view of the present invention.
Figure 4:
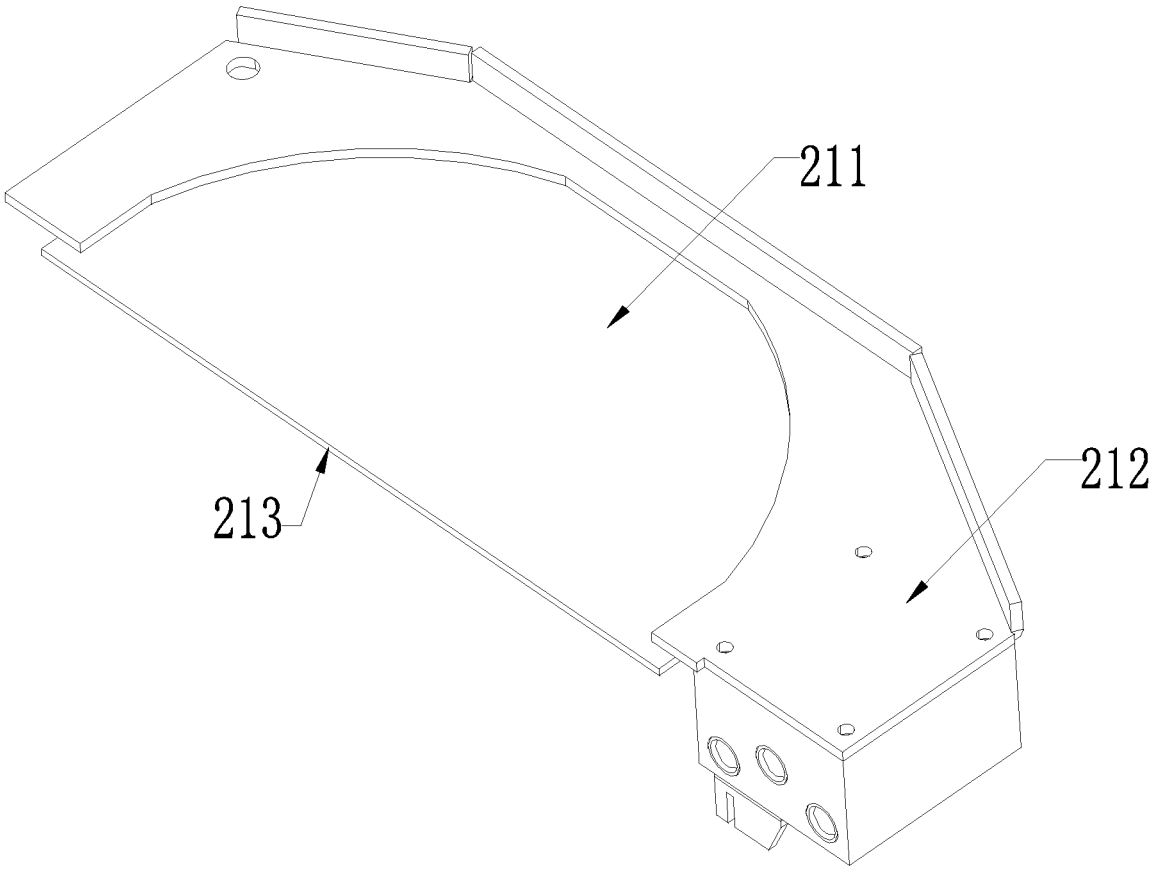
FIG. 4 is a detailed view of the frosting component in FIG. 1.

As shown in FIGS. 1 to 3, a gradient frosting system according to the present embodiment comprises a light processing mechanism 1 arranged in a direction of a primary optical axis of a light beam, a frosting mechanism 2 arranged perpendicular to the primary optical axis of the light beam, and a power mechanism 3 for outputting power to drive the frosting mechanism to move, wherein the power mechanism 3 is arranged below the frosting mechanism 2, the frosting mechanism 2 comprises two frosting components 210, including a left frosting component and a right frosting component, moving towards or away from each other, and the left and right frosting components 210 are arranged on the power mechanism 3 and driven by the power mechanism 3 to conduct open-close motion in a plane perpendicular to the primary optical axis.

In this embodiment, the system comprises two groups of frosting mechanisms 2 arranged up and down in the plane perpendicular to the primary optical axis and two groups of power mechanisms 3 connected to the frosting mechanisms 2, the power mechanisms 3 are arranged corresponding to the frosting mechanisms 2 one by one, and each group of the frosting mechanisms 2 is provided with two frosting components 210 moving towards or away from each other.

Each group of power mechanism 3 comprises a slider component 310 and a driving component 320, the slider component 310 is respectively connected to the frosting component 210 and the driving component 320, a support frame 4 is provided below the driving component 320, and the slider component 310 is driven by the driving component 320 to move to enable the left and right frosting components 210 to conduct open-close motion in the plane perpendicular to the primary optical axis.

The slider component 310 comprises two sliders 311 for driving the frosting components 210 to move and a sliding shaft 312 for providing a sliding rail for guiding the sliders 311, the two the sliders 311 are respectively connected to the left and right frosting components 210, the sliders 311 passes through the sliding shaft 312, two ends of the sliding shaft 312 are respectively provided with a sliding shaft fixing base 313 for fixing the sliding shaft 312, and the bottom of the sliding shaft base 313 is fixed to the support frame 4.

The sliding shaft 312 is provided, in the middle, with a limiting member 314 for limiting the travel distance of the slider, and the limiting member 314 passes through the sliding shaft 312.

The driving component 320 comprises a transfer mechanism for driving the slider 311 to move and a driving motor 321 for driving the transfer mechanism to move, the driving motor 321 is mounted below the support frame 4 and connected to the transfer mechanism, and the transfer mechanism is mounted above the support frame 4 and connected to the slider component 310.

The transfer mechanism comprises a driving wheel 322, a driven wheel 323 and a driving belt 324, the driving wheel 322 is connected to the driving motor 321, the driven wheel 323 and the driving wheel 322 are respectively mounted below the slider component 310, and the driving belt 324 is mounted on the driving wheel 322 and the driven wheel 323 and follows the motion of the driving wheel 322.

Two ends of the driving belt 324 are respectively provided with two symmetrically arranged sliding guides 325, and the sliding guide 325 is connected to the slider 311 and follows the motion of the driving belt 324.

The light processing mechanism 1 comprises a light source component 110, a focusing component 120, a magnifying lens component 130 and a fixed lens component 140, which are sequentially arranged in the direction of the primary optical axis of the light beam, the frosting mechanism 2 is arranged between the focusing component 120 and the fixed lens component 140, and the magnifying lens component 130 is arranged between the frosting mechanism 2 and the power mechanism 3 and forms a frosting module with the frosting mechanism 2.

The frosting component 210 comprises a frosting plate 211 and a mounting plate 212 for carrying and mounting the frosting plate 211, and the mounting plate 212 is connected to the slider 311.

The frosting steps of the present embodiment are as follows.

When the driving motor 321 is actuated, the driving belt 324 will rotate in a loop with the drive of the driving motor 321, the two sliding guides 325 on the driving belt 324 will move towards or away from each other with the cyclic rotation of the driving belt 324, so as to drive the sliders 311 on the sliding guides 325 to move in a reciprocating motion on the sliding shaft 312, such that the left and right frosting components 210 on the sliders 311 can be driven by the sliders 311 to conduct open-close motion in a loop. When the left and right frosting components 210 are opened, light beams can be projected from the magnifying lens component 130 to the fixed lens component 140 without being shielded, and then be projected from the fixed lens component 140 to the outside without any frosting effects; when the left and right frosting components 210 are closed, the light beams can be shielded by the frosting components 210 when passing therethrough, and only some of the light beams can be projected to the outside, thereby generating a hazy effect of frosting; and when multi-level left and right frosting components 210 are closed, more light beams can be shielded by the frosting components 210, which cannot be projected to the outside, thereby generating a stronger frosting effect.

Embodiment 2

This embodiment differs from Embodiment 1 in that frosting plates 211 of the left frosting component and the right frosting component protrude from the mounting plate 212 at the respective sides where they are located, and the left frosting component and the right frosting component are arranged up and down at an interval at height. During the relative movement of the left and right frosting components under the drive of the sliders 311, when in the same plane parallel to a primary optical axis, the frosting plates 211 of the left and right frosting components are in a closed state. The left and right frosting plates then continue to move forward towards each other until coming into contact with a limiting member 314. During such process, the left and right frosting plates are in a partially overlapping state, the left and right frosting components thus move in an open-close-overlap motion in a plane perpendicular to the primary optical axis, achieving a gradient frosting effect which is from no frosting effect to having frosting effect, and from shallow to deep.

The invention claimed is:

1. A gradient frosting system, comprising a light processing mechanism arranged in a direction of a primary optical axis of a light beam;

a frosting mechanism perpendicular to the primary optical axis of the light beam; and a power mechanism for outputting power to drive the frosting mechanism to move;

wherein the frosting mechanism comprises two frosting components including a left frosting component and a right frosting component, the left frosting component and the right frosting component move towards or away from each other and are arranged on the power mechanism and driven by the power mechanism to conduct open-close motion in a plane perpendicular to the primary optical axis, wherein the light processing mechanism comprises a light source component, a focusing component, a magnifying lens component and a fixed lens component, which are sequentially arranged in the direction of the primary optical axis of the light beam, the frosting mechanism is arranged between the focusing component and the fixed lens component, and the magnifying lens component is arranged between the frosting mechanism and the power mechanism and forms a frosting module with the frosting mechanism.

2. The gradient frosting system according to claim 1, wherein groups of frosting mechanisms are provided and arranged up and down in the plane perpendicular to the primary optical axis; groups of power mechanisms are provided and arranged corresponding to the frosting mechanisms one by one; and each group of the frosting mechanisms is provided with two frosting components moving towards or away from each other.

3. The gradient frosting system according to claim 1, wherein the power mechanism comprises a slider component and a driving component, the slider component is respectively connected to the frosting component and the driving component, and the slider component is driven by the driving component to move towards or away from each other to enable the left and right frosting components to conduct open-close motion in the plane perpendicular to the primary optical axis.

4. The gradient frosting system according to claim 3, wherein the slider component comprises two sliders for driving the frosting components to move and a sliding shaft or a sliding rail for guiding the sliders, the two sliders are respectively connected to the left and right frosting components, and the sliders are arranged on the sliding shaft or the sliding rail.

5. The gradient frosting system according to claim 4, wherein two ends of the sliding shaft are respectively provided with a sliding shaft fixing base for fixing the sliding shaft, the sliding shaft is provided, in the middle, with a limiting member for limiting the travel distance of the slider, and the limiting member passes through the sliding shaft.

6. The gradient frosting system according to claim 4, wherein the driving component comprises a transfer mechanism for driving the slider to move and a driving motor for driving the transfer mechanism to move, the driving motor is mounted below a support frame and is connected to the transfer mechanism, and the transfer mechanism is mounted above the support frame and connected to the slider component.

7. The gradient frosting system according to claim 6, wherein the transfer mechanism comprises a driving wheel, a driven wheel and a driving belt, the driving wheel is connected to the driving motor, the driven wheel and the driving wheel are respectively mounted below the slider component, the driving belt is mounted on the driving wheel and the driven wheel and follows the motion of the driving wheel, the two sliders are respectively and correspondingly arranged at two sides of the driving belt, and the two sides of the driving belt respectively provide driving forces in opposite directions for the two sliders.

8. The gradient frosting system according to claim 7, wherein the driving belt is provided with two symmetrically arranged sliding guides, and the sliding guide is connected to the slider component and follows the motion of the driving belt.

9. The gradient frosting system according to claim 8, wherein the frosting component comprises a frosting plate and a mounting plate for carrying and mounting the frosting plate, the mounting plate is connected to the slider, and the slider is connected to the sliding guide.

10. The gradient frosting system according to claim 9, wherein the frosting plate is coated with a film in a tangent plane thereof, the tangent is parallel to the primary optical axis and the light beam enters the tangent plane tangentially, the film is configured for preventing light from being refracted from the tangent plane to interfere with light rays.

11. The gradient frosting system according to claim 1, wherein the power mechanism comprises a slider component and a driving component, the slider component is respectively connected to the frosting components and the driving component, the left and right frosting components are arranged up and down at an interval in height, and the slider component is driven by the driving component to move towards or away from each other to enable the left and right frosting components to conduct open-close-overlap motion in the plane perpendicular to the primary optical axis.

12. The gradient frosting system according to claim 11, wherein the slider component comprises two sliders for driving the frosting components to move and a sliding shaft or a sliding rail for guiding the sliders, the two sliders are respectively connected to the left and right frosting components, and the sliders are arranged on the sliding shaft or the sliding rail.

13. The gradient frosting system according to claim 12, wherein two ends of the sliding shaft are respectively provided with a sliding shaft fixing base for fixing the sliding shaft, the sliding shaft is provided, in the middle, with a limiting member for limiting the travel distance of the slider, and the limiting member passes through the sliding shaft.

14. The gradient frosting system according to claim 12, wherein the driving component comprises a transfer mechanism for driving the slider to move and a driving motor for driving the transfer mechanism to move, the driving motor is mounted below a support frame and is connected to the transfer mechanism, and the transfer mechanism is mounted above the support frame and connected to the slider component.

15. The gradient frosting system according to claim 14, wherein the transfer mechanism comprises a driving wheel, a driven wheel and a driving belt, the driving wheel is connected to the driving motor, the driven wheel and the driving wheel are respectively mounted below the slider component, the driving belt is mounted on the driving wheel and the driven wheel and follows the motion of the driving wheel, the two sliders are respectively and correspondingly arranged at two sides of the driving belt, and the two sides of the driving belt respectively provide driving forces in opposite directions for the two sliders.

16. The gradient frosting system according to claim 15, wherein the driving belt is provided with two symmetrically arranged sliding guides, and the sliding guide is connected to the slider component and follows the motion of the driving belt.

17. The gradient frosting system according to claim 16, wherein the frosting component comprises a frosting plate and a mounting plate for carrying and mounting the frosting plate, the mounting plate is connected to the slider, and the slider is connected to the sliding guide.

18. The gradient frosting system according to claim 17, wherein the frosting plate is coated with a film in a tangent plane thereof, the tangent plane is parallel to the primary optical axis and the light beam enters the tangent plane tangentially, the film is configured for preventing light from being refracted from the tangent plane to interfere with light rays.

* * * * *